US007234236B2

(12) United States Patent
Derleth et al.

(10) Patent No.: US 7,234,236 B2
(45) Date of Patent: Jun. 26, 2007

(54) METHOD FOR PRODUCING A CONTACT PART

(76) Inventors: Horst Derleth, deceased, late of Diedorf (DE); by Susanne Derleth, legal representative, Mittelbuehlstr. 7, 86420 Diedorf (DE); Matthias Schweizer, Rochusweg 16, 86568 Hollenbach (DE); Peter Vache, Adelsgasse 9, 91336 Heroldsbach (DE)

( * ) Notice: Subject to any disclaimer, the term of this patent is extended or adjusted under 35 U.S.C. 154(b) by 137 days.

(21) Appl. No.: 10/523,203

(22) PCT Filed: Jul. 17, 2003

(86) PCT No.: PCT/DE03/02412

§ 371 (c)(1),
(2), (4) Date: Aug. 8, 2005

(87) PCT Pub. No.: WO2004/017469

PCT Pub. Date: Feb. 26, 2004

(65) Prior Publication Data

US 2006/0089058 A1 Apr. 27, 2006

(30) Foreign Application Priority Data

Jul. 31, 2002 (DE) ..... 102 35 053

(51) Int. Cl.
*H01R 43/04* (2006.01)
*H01R 4/10* (2006.01)
*H01R 9/05* (2006.01)

(52) U.S. Cl. ..... 29/861; 29/857; 29/862; 29/876; 439/877; 174/75 C

(58) Field of Classification Search ..... 29/861, 29/857, 862, 879, 876, 884, 827; 439/877, 439/843, 851; 174/75 C, 82, 83, 19; 200/51.02, 200/51.12
See application file for complete search history.

(56) References Cited

U.S. PATENT DOCUMENTS 4,550,972 A * 11/1985 Romak ..... 439/839

(Continued)

FOREIGN PATENT DOCUMENTS

DE 36 29 740 A1 3/1987

(Continued)

*Primary Examiner*—A. Dexter Tugbang
*Assistant Examiner*—Tai Van Nguyen
(74) *Attorney, Agent, or Firm*—Bachman & LaPointe, P.C.

(57) ABSTRACT

The invention relates to a method for producing a conductive contact part for a detachable electric plug-in connection. Said method provides a contact element comprising a bushing part, sections of which contain longitudinal slits and which has ribs distributed around its periphery. A sleeve part, which can surround the bushing part and cover the ribs, comprises two opposing end faces. The sleeve part is placed and positioned in an approximately coaxial manner in relation to the bushing part, in such a way that it covers the ribs, the positioned sleeve part being locked by one of its two faces on the bushing part. The bushing part is elastically twisted about its central axis, in such a way that the ribs are towards said central axis and the other face of the sleeve part is locked on the bushing part that is held in a twisted position against the elastic restoring force of the ribs. A contact part, designed for mass-reduction, with defined elastic properties of the ribs can thus be produced in a reproducible manner.

16 Claims, 3 Drawing Sheets

U.S. PATENT DOCUMENTS

| | | | | |
|---|---|---|---|---|
| 4,752,253 | A | 6/1988 | Neumann et al. | |
| 5,376,012 | A * | 12/1994 | Clark | 439/80 |
| 5,474,479 | A * | 12/1995 | Bennett et al. | 439/843 |
| 5,951,337 | A * | 9/1999 | Brake | 439/825 |
| 6,186,841 | B1 * | 2/2001 | Jacobsson | 439/851 |

FOREIGN PATENT DOCUMENTS

| | | |
|---|---|---|
| DE | 100 05 297 A1 | 8/2001 |
| EP | 0 283 768 A2 | 3/1988 |
| WO | WO 00/07266 | 2/2000 |
| WO | WO 01/15277 A1 | 3/2001 |
| WO | WO 02/23678 A1 | 3/2002 |

* cited by examiner

METHOD FOR PRODUCING A CONTACT PART

CROSS REFERENCE TO RELATED APPLICATIONS

This application is the US National Stage of International Application No. PCT/DE2003/002412, filed Jul. 17, 2003 and claims the benefit thereof. The International Application claims the benefits of German application No. 10235053.1 filed Jul. 31, 2002, both applications are incorporated by reference herein in their entirety.

FIELD OF INVENTION

The invention relates to a method for producing a conductive contact part for a detachable electrical plug-in connection.

BACKGROUND OF INVENTION

Electrical plug-in connections with contact parts of the type stated above are for example used as round connectors for power transfer to motors and drives but also for signal transmission to node points in bus systems and controllers. The male and female part of a plug-in electrical connection each feature an insulating element arranged detachably in a connector housing which comprises holes arranged coaxially to the plug-in direction to accept conductive contact parts. In the female part of the electrical plug-in connection the contact parts are formed by contact bushes which, when the connection is plugged in, accept contact parts of the male part embodied as contact pins in order to establish electrical contact. The present invention relates to the production of contact parts of the female part of the plug-in connection embodied as bushing contacts or jacks.

German Application DE 100 05 297 Al discloses a known method for producing a conductive contact part for a detachable electrical connection in which a contact element in which a cage-type bushing part is provided featuring a plurality of ribs extending along parallel axes and spaced apart from one another and with a protective sleeve which can be pushed over the ribs of the bushing part with reinforced walls at its inner end. A permanent torque is now subsequently applied to the bushing part by turning it by a defined angle, preferably by 10° relative to its extended position. In a subsequent assembly step the protective sleeve is pushed onto the contact elements formed in this way and pushed forward with the reinforced end onto its contact area. The twisted ribs of the bushing part are bent inwards by the torsion process in the form of hyperbolic surfaces and in their entirety form a plurality of local contact points which are under elastic pretension around its circumference when the contact pin is plugged into the bushing part.

With this known production method it is difficult to obtain the elastic characteristics of the ribs bent inwards and thereby a defined press-on force of the ribs on an introduced contact in a reproducible way. To achieve a lasting torsion of for example 10°, in the known method the bushing part must initially be rotated by a larger angle which is to be defined, in order, because of the elastic part of the deformation after releasing the torsion to assume the plastically deformed state. This so-called over rotation of the bushing part is sensitive to material variations so that there is a certain level of scrap. In addition the ribs of the twisted bushing part form a sensitive construction which could be damaged when the protective sleeve is subsequently fitted, especially when the end of the protective sleeve with reinforced walls is to be fixed to the bushing part by pressing it on.

SUMMARY OF INVENTION

The object of the invention is to specify a method for producing a conductive contact part of the type stated at the start of this document which allows a defined level of adjustment of the twisting of the bushing part and thereby of the elastic characteristics of the ribs bent inwards in a reproducible way with the least possible scrap in series production.

In accordance with the invention the object is achieved by the claims. To protect the ribs during and after the torsion process of the bushing part, the sleeve part is arranged beforehand approximately coaxially to the bushing part and positioned so that it covers the latter's ribs and locks into the bushing part with one of its two end faces. This provides initial protection for the sensitive ribs against eternal mechanical influences during further procedural steps. By locking into the bushing part the sleeve part forms a guide for the subsequent torsion process. The bushing part is now twisted by a defined angle which matches the bending of the ribs investigated beforehand for its elastic properties around the center axis of the contact element and is held in this state against the elastic restoring force of the ribs. This state with its properties is now "frozen", in that the sleeve part is also locked with its other end onto the bushing part. Depending on bushing material and material dimension, the mechanical properties of the ribs can be adjusted via a torsion of the bushing part in the completely elastic or also the partly plastic area.

In an advantageous embodiment of the method in accordance with the invention the sleeve part locks into the bushing part by mechanical latching. Alternatively the two parts can be locked together by laser welding, which has production benefits as regards speed of production and production precision.

In a preferred embodiment of the method in accordance with the invention a radial expansion protection ring extending radially in the direction of the circumference is inserted into the positioned sleeve part. This limits the outwards spring movement of the ribs which are bent inwards when a contact pin is introduced into the bushing part. This mechanical stop thus typically enables overtorsion of the sensitive ribs to be prevented during the connection process. It also prevents the contact element changing because of tolerance problems or the effects of a mechanical force, always guaranteeing secure contacting while the connection is in operation. In addition this enables the connection to carry higher currents.

In preferred embodiment of the method in accordance with the invention at least one radially expanded section is formed on the contact element. Said extension provides a locking edge at the transition to the non-extended part of the contact element which for example interacts with locking elements of the insulating body of a connector part. On introduction of the contact part into a mating hole of the insulating body the locking elements engage behind the locking edge pointing radially inwards in order to axially fix the contact part into the insulating body. In that radially expanded sections with different diameters are formed at various axial positions of the contact element, one and the same contact part can be used for different appropriately designed insulating bodies.

Further advantages of the method in accordance with the invention are produced by further dependent claims as well as by the exemplary embodiment shown in the drawings.

DETAILED DESCRIPTION OF INVENTION

Figure 1:
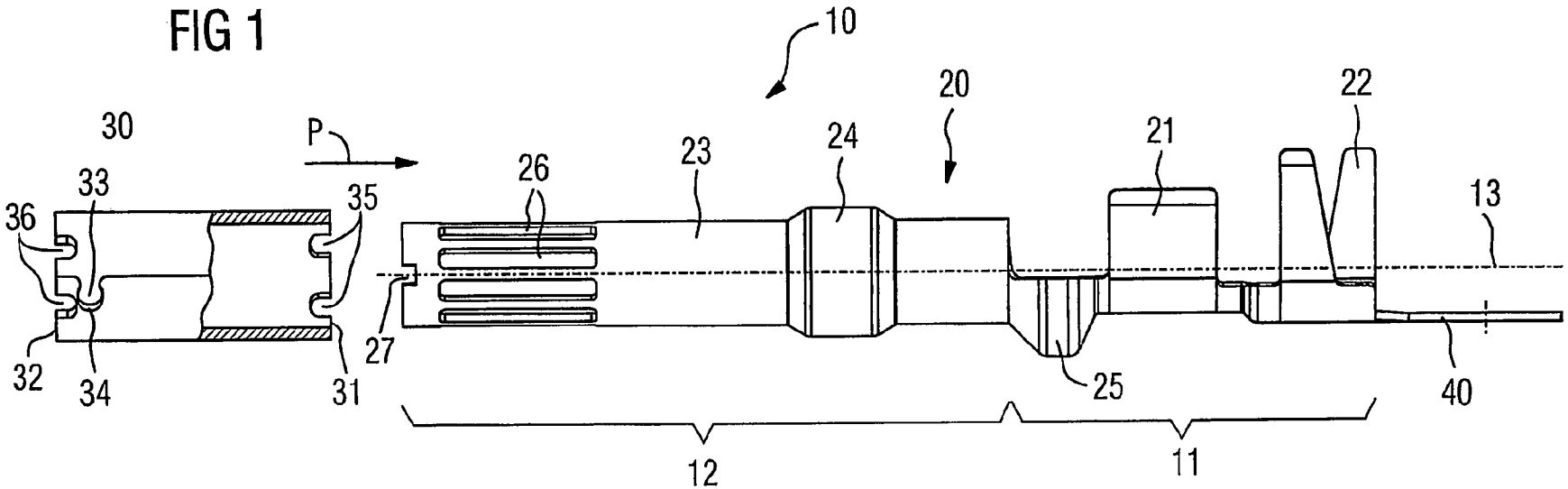
FIG. 1 to FIG. 5 depict the contact element and the sleeve part of the contact part at various stages of the production procedure in accordance with the invention as schematic diagrams viewed from the side in each case.

According to FIG. 1, in the inventive process for producing a conductive contact part 10 for a detachable electrical plug-in connection a contact element 20 and a sleeve part 30 are provided. In a previous procedural step not shown flat contact arrangements of a contact element 20 or of the sleeve part 30 repeating at a specific spacing have been punched out of a strip material. The contact arrangements of the contact element 20 in this case remain connected to a carrier tape 40 of the strip material. The punched out contact elements 20 then remain attached to a transverse tape suitable for automated large-volume production connected to the stationary carrier tape 40 of the strip material used as initial material and can be sent to customers in this state which is suitable for machine processing where actual connector assembly is to be undertaken. After punching out, the strip material which consists of a Cu—Sn alloy is electrically surface treated in the course of the production process. This involves for example initially applying an Ni layer as an adhesion layer, then an Au layer and if necessary a covering Sn layer. From the arrangement of a contact element 20 in a connecting area 11 of the contact part 10, connecting tabs 21 for a crimping contact to an insulating part of a conductor to be connected as well as connecting tabs 22 of a clamp connection to the insulated part of the electrical conductor not shown are bent. In the contact area 12 of the contact part 10 the arrangement of the contact element 20 is rolled up into a bushing part 23. On the contact element 20 radially expanded sections 24 and 25 are formed which are effectively connected to locating elements attached to an insulating body of a connector part accommodating the contact parts 20, in order to fix the axial position of the contact part 10 in a mating hole of the insulating body. The first radially expanded section 24 is of a smaller diameter than the second radially expanded section 25 spaced axially from it. This allows the contact piece 10 to be used for differently prepared insulating bodies. The bushing part 23 of the contact element 20 is slotted in parallel to the central axis 13 of the contact piece 10, i.e. along the plug-in direction P, so that it has a plurality of bar-shaped ribs 26. At the connector end of the contact element 20 the bushing part 23 has a pair of groove-shaped turning slots 27 of which the function will be explained in greater detail below. The sleeve part 30 is also rolled from a flat material and features two opposite end faces 31 and 32. Locating tabs 33 and locating cutouts 34 assigned to each other in pairs are formed on the edges and fit tightly into each other when the material is rolled to form the cylindrical sleeve part 30. The sleeve 30 also has fixing cutouts 35 and 36 on its ends 31 and 32, the function of said cutouts also being explained in greater detail below.

In a first procedural step shown, in accordance with FIG. 1, the connection-side end of sleeve part 30 is now pushed onto bushing part 23 of the contact element 20 and positioned such that the ribs 26 are covered by the sleeve part 30.

Figure 2:
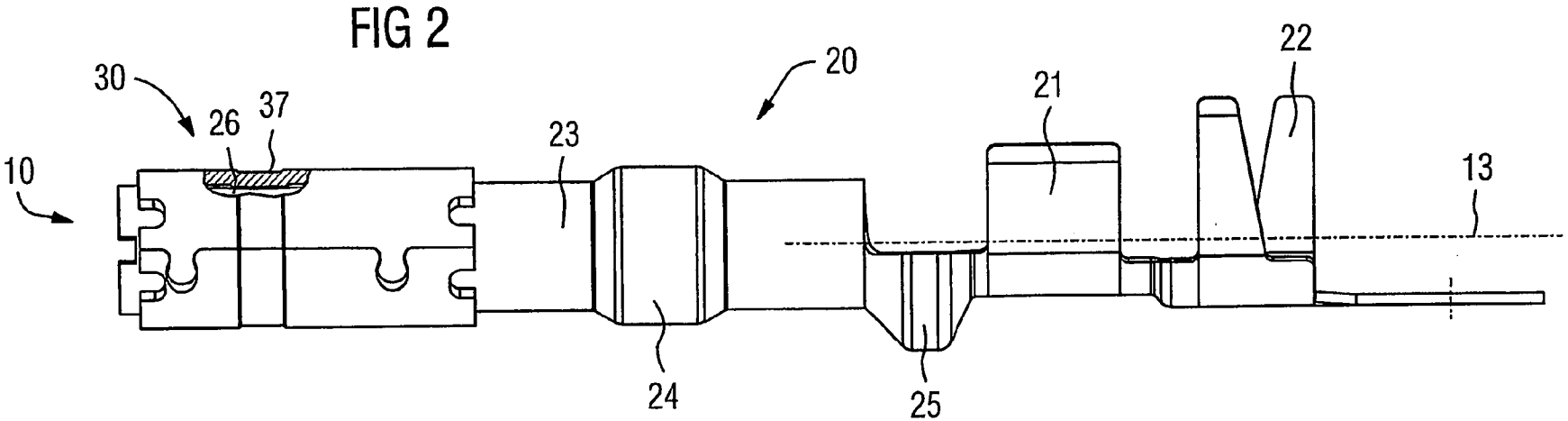

In accordance with FIG. 2 a radial expansion protection ring extending around the circumference is then pressed into the positioned sleeve part 30. The ring 37 in the sleeve part 30 serves as a mechanical stop for the radial outwards deflection of the ribs 26 and thus protects the latter from over-extension and thereby against the loss of the elastic properties necessary for establishing contact to the introduced contact pin. In addition the ring 37 has the advantage for production that in further steps the sleeve part 30 can no longer shake free downwards from the contact element 20 of the contact part 10 and thus become lost.

Figure 3:
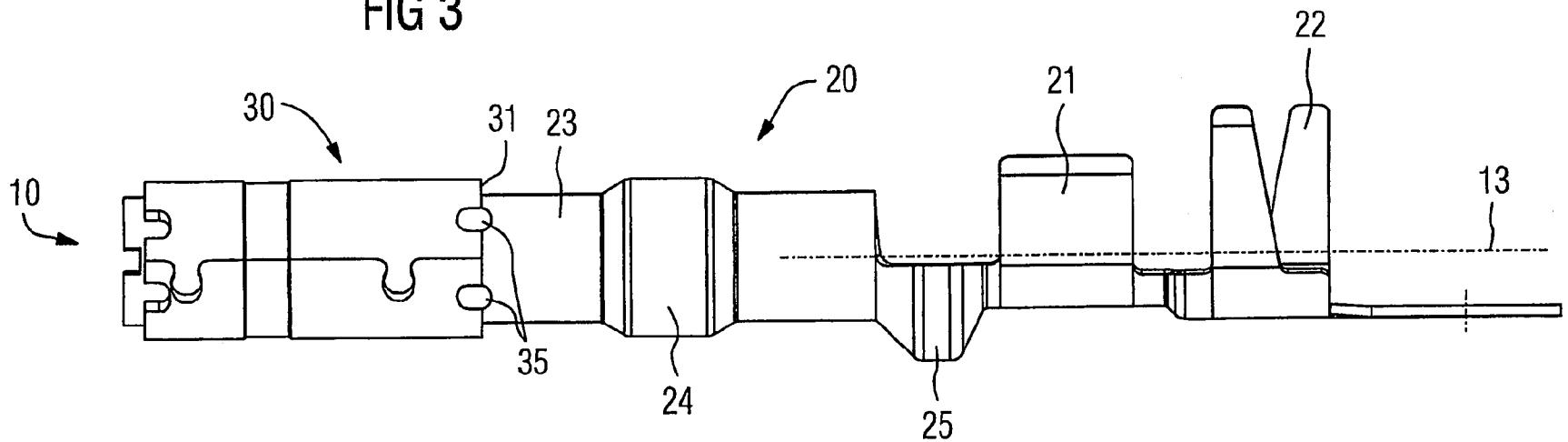

In an axial position of sleeve part 30, in which the radial expansion protection ring 37 comes to rest in the middle of the ribs 26 the sleeve part 30 is locked by its connection-side end 31 into the bushing part 23 of the contact element 20 by laser welding at the fixing cutouts 35. This step, shown in FIG. 3, fixes the position of the sleeve part 30 on the contact element 20.

Figure 4:
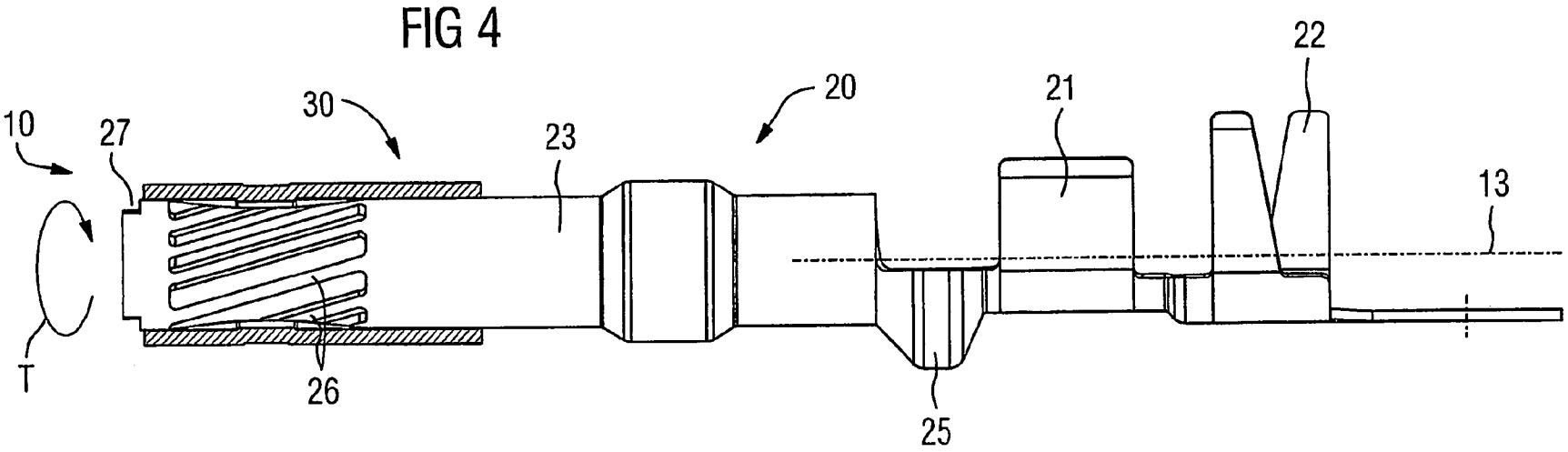
Figure 5:
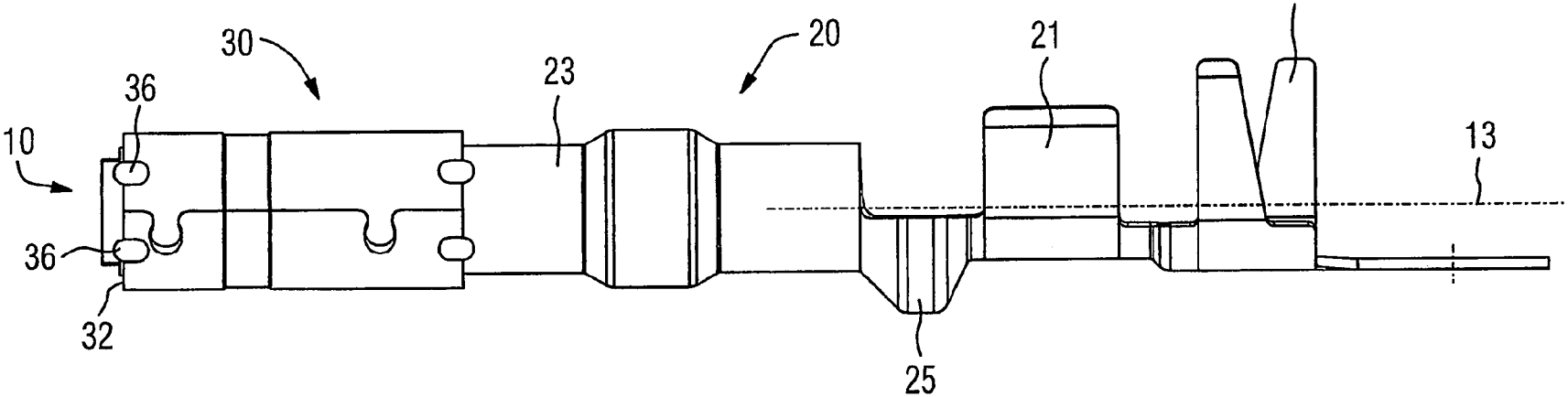

In the step shown in FIG. 4 a turning part of a torsion tool not shown is engaged with rotation slot 27 on the connector-side end of the bushing part 23 in order to turn the bushing part 23. To this end the contact element 20 is secured against-turning outside the area of the ribs 26 on the connection side and is twisted around the center axis 13 in direction T by a specifiable angle, by 90° in the example shown, on the plug-in side. In this case ribs 26 bend in the form of an arc in towards the central axis 13 so that the area of the ribs 26 forms a cage-like construction which fits snuggly in the form of a one-sheeted hyperboloid. When twisted the sleeve part 30 advantageously serves as a guide and prevents problems with or distortion of the bushing part 23 during the torsion process. To simplify the diagram the bent ribs 26 are only shown schematically in FIG. 4. By selecting the angle of rotation the extent of bending of the ribs 26 as well as their spring constant against an outwards radial deflection can be set. Further defining parameters are the material as well as the dimensioning of the ribs 26.

Contrary to the teaching of the prior art the twisted contact element 20, regardless of whether the torsion that has taken place was still completely elastic or already partly plastic, is kept in this state and locked into the bushing part 23 by laser welding of the sleeve part 30 at its fixing cutouts 36. This retains the precise mechanical properties of the ribs 26 which were set during the torsion process. These can be easily determined in preliminary trials. Under the protective sleeve part 30 the ribs 26 bent inwards form a plurality of contact surfaces at which electrical contact is established between the bushing part 23 of the contact part 10 and a contact pin (not shown) introduced into the bushing part 23. When a contact pin is plugged into the bushing part 23 the ribs 26 are deflected radially outwards so that, because of their elastic recovery force, they press on the contact pin with a defined contact force. To avoid an over-extension of ribs 26 by too great a radial deflection the spring path of the ribs 26 is limited by an annular raised section of the expansion protection ring 37 on the inner side of the sleeve part 30.

It should be pointed out that the radial expansion protection ring 37 extending round the circumference can also be inserted after the sleeve part 30 has been locked. Nor does it make any difference which of the two ends 31, 32 of the sleeve part 30 are first locked before the twisting of the bushing part 23.

The invention claimed is:

1. A method for establishing an electrical connection using a detachable plug-in connection, the method comprising:

providing a contact element having a sectionally lengthwise-slotted shaft part, the shaft part having ribs arranged around a circumference of the contact element;

providing a sleeve part adapted to surround the shaft part and covering the ribs, the sleeve part having two ends;

positioning the sleeve part essentially coaxially relative to the shaft part for covering the ribs by the sleeve part;

connecting the sleeve part to the shaft part at one of the ends by plugging the sleeve part over the shaft part;

twisting the shaft part around a central axis of the shaft part such that the ribs bend inwards towards the central axis, the bended ribs formed as arcs; and locking the sleeve part to the shaft part at the other end, wherein the shaft part is held twisted against an elastic reset force caused by the ribs.

2. The method according to claim 1, wherein the sleeve part is locked onto to the shaft part by mechanical locking.

3. The method according to claim 2, wherein a radial expansion protection ring extending around the circumference is pressed into the positioned sleeve part.

4. The method according to claim 2, wherein at least one radially extended section is formed on the contact element.

5. The method according to claim 2, wherein flat contact arrangements of the contact element, and if necessary of the sleeve part repeating at a defined spacing distance are punched out of a strip material, wherein the arrangements remain connected to a carrier tape of the strip material, wherein the punched-out contact arrangements are surface-treated, and wherein the contact element is formed from the contact arrangements by rolling the shaft part and bending up connection tabs and if necessary the sleeve part, is formed through rolling.

6. The method according to claim 1, wherein the sleeve part (30) is locked onto to the shaft part by laser welding.

7. The method according to claim 6, wherein a radial expansion protection ring extending around the circumference is pressed into the positioned sleeve part.

8. The method according to claim 6, wherein at least one radially extended section is formed on the contact element.

9. The method according to claim 6, wherein flat contact arrangements of the contact element, and if necessary of the sleeve part repeating at a defined spacing distance are punched out of a strip material, wherein the arrangements remain connected to a carrier tape of the strip material, wherein the punched-out contact arrangements are surface-treated, and wherein the contact element is formed from the contact arrangements by rolling the shaft part and bending up connection tabs and if necessary the sleeve part, is formed through rolling.

10. The method according to claim 1, wherein a radial expansion protection ring extending around the circumference is pressed into the positioned sleeve part.

11. The method according to claim 10, wherein at least one radially extended section is formed on the contact element.

12. The method according to claim 10, wherein flat contact arrangements of the contact element, and if necessary of the sleeve part repeating at a defined spacing distance are punched out of a strip material, wherein the arrangements remain connected to a carrier tape of the strip material, wherein the punched-out contact arrangements are surface-treated, and wherein the contact element is formed from the contact arrangements by rolling the shaft part and bending up connection tabs and if necessary the sleeve part, is formed through rolling.

13. The method according to claim 1, wherein at least one radially extended section is formed on the contact element.

14. The method according to claim 13, wherein flat contact arrangements of the contact element, and if necessary of the sleeve part repeating at a defined spacing distance are punched out of a strip material, wherein the arrangements remain connected to a carrier tape of the strip material, wherein the punched-out contact arrangements are surface-treated, and wherein the contact element is formed from the contact arrangements by rolling the shaft part and bending up connection tabs and if necessary the sleeve part, is formed through rolling.

15. The method according to claim 1, wherein flat contact arrangements of the contact element, and if necessary of the sleeve part repeating at a defined spacing distance are punched out of a strip material, wherein the arrangements remain connected to a carrier tape of the strip material, wherein the punched-out contact arrangements are surface-treated, and wherein the contact element is formed from the contact arrangements by rolling the shaft part and bending up connection tabs and if necessary the sleeve part, is formed through rolling.

16. The method according to claim 15, wherein locating tabs and locating cutouts arranged in pairs are formed on a contact arrangement of the sleeve part, wherein, when the sleeve part is rolled, the locating tabs engage in the assigned locating cutouts to form a tight fit.

* * * * *